US006973900B2

(12) United States Patent
Yamada et al.

(10) Patent No.: US 6,973,900 B2
(45) Date of Patent: Dec. 13, 2005

(54) VALVE DRIVE SYSTEM AND METHOD

(75) Inventors: Tomomi Yamada, Susono (JP); Keiji Yoeda, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/773,299

(22) Filed: Feb. 9, 2004

(65) Prior Publication Data

US 2004/0173171 A1 Sep. 9, 2004

(30) Foreign Application Priority Data

Mar. 5, 2003 (JP) ..... 2003-057969

(51) Int. Cl.[7] ..... F01L 9/04

(52) U.S. Cl. ..... 123/90.11; 251/129.01; 251/129.1; 251/129.15

(58) Field of Search ..... 123/90.11; 251/129.01, 251/129.1, 129.15, 129.16

(56) References Cited

U.S. PATENT DOCUMENTS

| | | | | |
|---|---|---|---|---|
| 4,614,170 | A | 9/1986 | Pischinger et al. | |
| 6,170,445 | B1 | 1/2001 | Hattori et al. | |
| 6,276,317 | B1 * | 8/2001 | Yoeda et al. | 123/90.11 |
| 6,343,577 | B2 * | 2/2002 | Toriumi | 123/90.11 |

* cited by examiner

*Primary Examiner*—Thomas Denion
*Assistant Examiner*—Zelalem Eshete
(74) *Attorney, Agent, or Firm*—Oliff & Berridge, PLC

(57) ABSTRACT

When an internal combustion engine including an electromagnetic valve drive mechanism driving a plurality of valves is to be stopped, application of current to at least one magnet for one valve or valve group is stopped at a different timing from another valve or valve group.

20 Claims, 8 Drawing Sheets

VALVE DRIVE SYSTEM AND METHOD

INCORPORATION BY REFERENCE

The disclosure of Japanese Patent Application No. 2003-057969 filed on May 5, 2003 including the specification, drawings and abstract is incorporated herein by reference in its entirety.

BACKGROUND OF THE INVENTION

1. Field of the Invention

The present invention relates to a valve drive system for an internal combustion engine and a method corresponding to the operation of the same system.

2. Description of the Related Art

A known electromagnetic valve mechanism incorporated in an internal combustion engine includes electromagnetic valves each having at least one magnet and a pair of springs as its main components (see JP-A 59-213913). Typically, such springs are arranged so as to hold each valve in its default state at the center between one end of the valve moving range at which the valve is fully open (will hereinafter be referred to as "fully open position" where appropriate) and another end at which the valve is fully closed (will hereinafter be referred to as "fully closed position" where appropriate). Setting the default valve position at such a middle position offers an advantage that less power is required to open, close, and hold the valve. With this arrangement, if current applied to the magnet holding the valve at the fully open or closed position is shut off, the valve then starts oscillating on its own due to the urging force of each spring. Hereinafter, such oscillation of each valve will be called "free oscillation."

When the valve is thus oscillating, it causes some noise (will be called "off-valve noise"). Thus, the related art mechanism described above involves a problem that it will be very noisy if such off-valve noise is simultaneously generated from a number of valves in an internal combustion engine having a plurality of cylinders.

Another electromagnetic valve system is known in which a valve is held at a fully closed position in its default state (see JP-A 2000-161032). However, such a system typically requires a complicated structure enabling the valve to be held at such an open position. Therefore, it is desirable to accomplish reduction of off-valve noise with an ordinary electromagnetic valve system.

SUMMARY OF THE INVENTION

In view of the above situation, the present invention has been made to provide an electronic valve drive system capable of reducing the above-stated off-valve noise occurring upon deactivating valve operation, and a method corresponding to the operation of such a system.

To achieve the above object, a first aspect of the present invention relates to a valve drive system for an internal combustion engine including: a plurality of valves; springs urging each of the valves towards a middle position between a fully open position and a fully closed position; magnets each supplied with current to generate electromagnetic force to retain each of the valves at the fully open or closed position against the urging force of each spring, and a controller that is adapted to stop application of current to at least one magnet for a first valve or a first valve group among the valves at a first timing and stop application of current to at least one magnet for a second valve or a second valve group among the valves at a second timing that is different from the first timing when the internal combustion engine is to be stopped.

According to this construction, when the internal combustion engine is to be stopped, application of current to the magnet(s) for the first valve or valve group is stopped at a different timing from the second valve or valve group whereby noise owing to free oscillation of each valve or valve group does not occur at the same time, which results in reduced off-valve noise at the time of stopping their operation.

In the above system, it is preferable that the valves be intake valves and/or exhaust valves of the internal combustion engine.

Also in the above system, it is preferable that the second timing be when free oscillation of the first valve or the first valve group has decayed to a specific level. In this case, application of current to the magnet for one valve is stopped after free oscillation of another valve is damped to some extent, therefore the off-valve noise can be reduced more reliably.

Also, valve displacement detecting means may additionally be provided which detects an amount the valve is displaced due to its free oscillation, and the controller may be further adapted to determine based on the valve displacement amount detected by the valve displacement detecting means that the free oscillation of the first valve or the first valve group has decayed to the specific level. In this case, it is possible to determine the timing of stopping application of current to the magnet for one valve or valve group after confirming that free oscillation of another valve or valve group has been damped enough. Thus, the valves can be immediately deactivated while reducing the off-valve noise in the above-described manner.

A second aspect of the present invention relates to a valve drive system for an internal combustion engine including: a valve; springs urging the valve towards a middle position between a fully open position and a fully closed position; a magnet supplied with current to generate electromagnetic force to retain the valve at the fully open or closed position against the urging force of each spring, and a controller that is adapted to control application of current to the magnet in such a way that the magnet generates electromagnetic force to bring the valve to the middle position while suppressing free oscillation of the valve when the internal combustion engine is to be stopped.

According to this construction, the valve is brought to the middle position by controlling application of current to the magnet while suppressing free oscillation of the valve, which reduces the degree or chance of noise that may otherwise be caused by such free oscillation of the valve.

In the valve drive system according to the second aspect of the invention, it is preferable that the valves be intake valves and/or exhaust valves of the internal combustion engine.

Also, it is preferable that valve lift detecting means be provided which detects an amount the valve is lifted and the controller be further adapted to perform a feedback control such that the detected valve lift amount converges on a prescribed target amount that changes in time. This feedback control achieves further reliability in reducing the off-valve noise during displacement of the valve.

Also, it is preferable that the controller be further adapted to stop application of current to the magnet at a predetermined timing when the valve has been brought from the fully open or closed position to a prescribed position close to the middle position.

In this case, the valve does not oscillate until it reaches the prescribed position. That is, the valve starts oscillating at the same position, however the intensity of this free oscillation is smaller than caused when the valve is released from the fully open or closed position. As well as reduction of the off-valve noise, this arrangement offers another advantage that such reduction of noise can be realized even if a relatively small magnet consuming small power is used.

Also, the valve may be provided in plurality and the above-stated timing may be set for each one of the valves or each one of valve groups formed among the valves. In this case, further reduction of the off-valve noise can be achieved.

A third aspect of the invention relates to a method for driving a plurality of valves mounted in an internal combustion engine including springs urging each valve towards a middle position between a fully open position and a fully closed position and magnets each supplied with current to generate electromagnetic force to retain each valve at the fully open or closed position against the urging force of each spring. This method includes the steps of stopping application of current to at least one magnet for a first valve or a first valve group among the valves at a first timing and stopping application of current to at least one magnet for a second valve or a second valve group among the valves at a second timing that is different from the first timing when the internal combustion engine is to be stopped.

A fourth aspect of the invention relates to a method for driving a valve mounted in an internal combustion engine including springs urging the valve towards a middle position between a fully open position and a fully closed position and a magnet supplied with current to generate electromagnetic force to retain the valve at the fully open or closed position against the urging force of each spring. This method includes the step of controlling application of current to the magnet in such a way that the magnet generates electromagnetic force to bring the valve to the middle position while suppressing free oscillation of the valve when the internal combustion engine is to be stopped.

According to the above-described methods, the off-valve noise resulting from free oscillation of each valve can be reduced as in the case of the electronic valve drive systems of the invention.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF THE PREFERRED EMBODIMENTS

Figure 1:
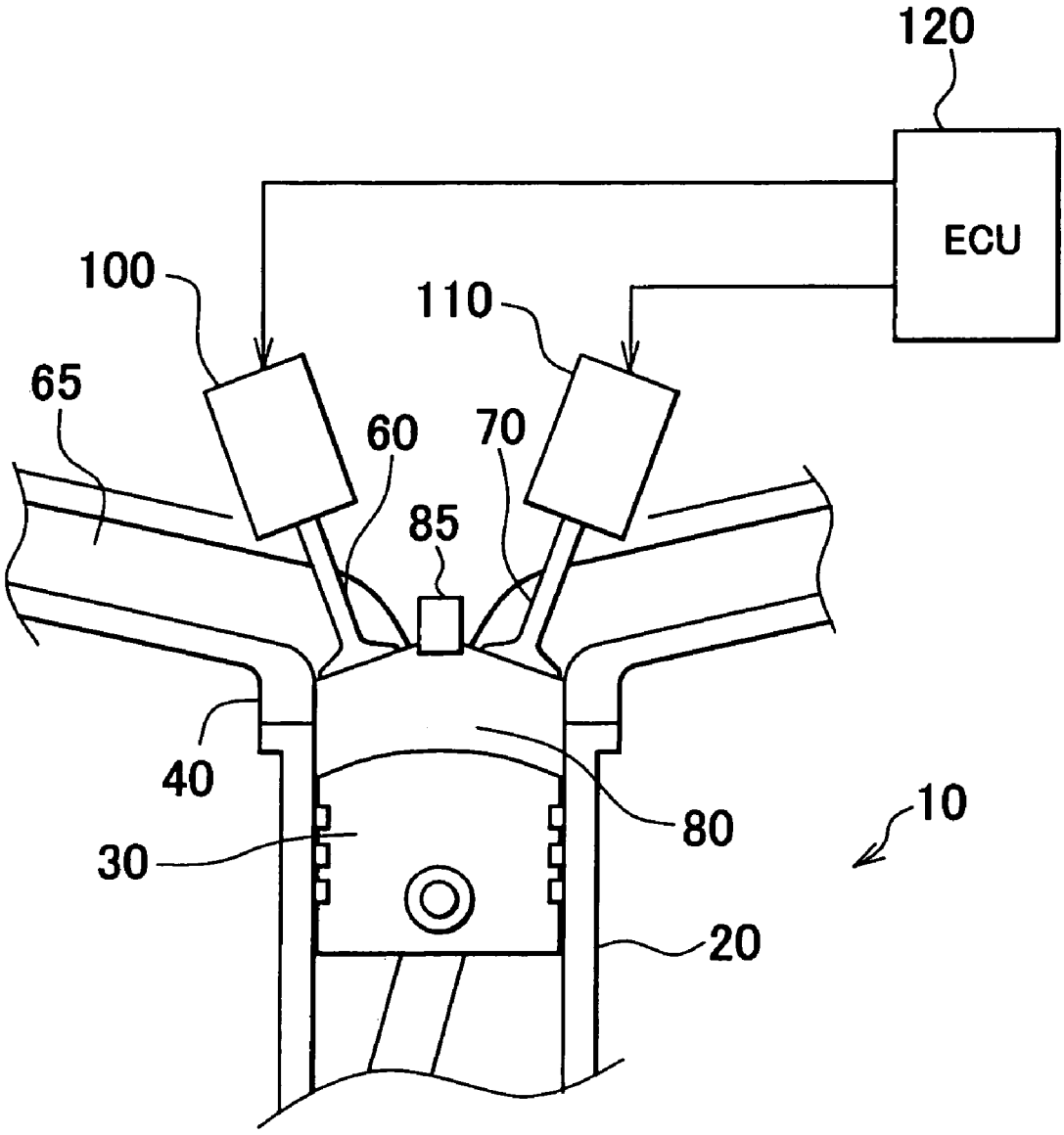
FIG. 1 is a view schematically showing the construction of a four-cylinder internal combustion engine incorporating a valve drive system according to a first exemplary embodiment of the present invention.

Exemplary embodiments of the present invention will hereinafter be described with reference to the accompanying drawings. FIG. 1 is a view schematically showing the construction of a four-cylinder internal combustion engine 10 incorporating a valve drive system according to a first exemplary embodiment of the present invention. This engine 10 is mounted in a vehicle. The engine 10 includes a cylinder block 20 and a cylinder head 40 which together define four cylinders (first to fourth cylinders) of the same engine 10. A piston 30 is provided in each cylinder so as to reciprocate therein when driven by fuel combustion. Intake valves 60 and exhaust valves 70 are provided in the cylinder head 40 and a combustion chamber 80 is defined by the cylinder head 40 and each piston 30 within each cylinder. Ignition plugs 85 for igniting air-fuel mixtures in the combustion chambers 80 are provided in the cylinder head 40. Note that the electromagnetic valve drive system of this embodiment will hereinafter be explained with regard to one of the four cylinders as a representative for descriptive convenience.

Figure 2:
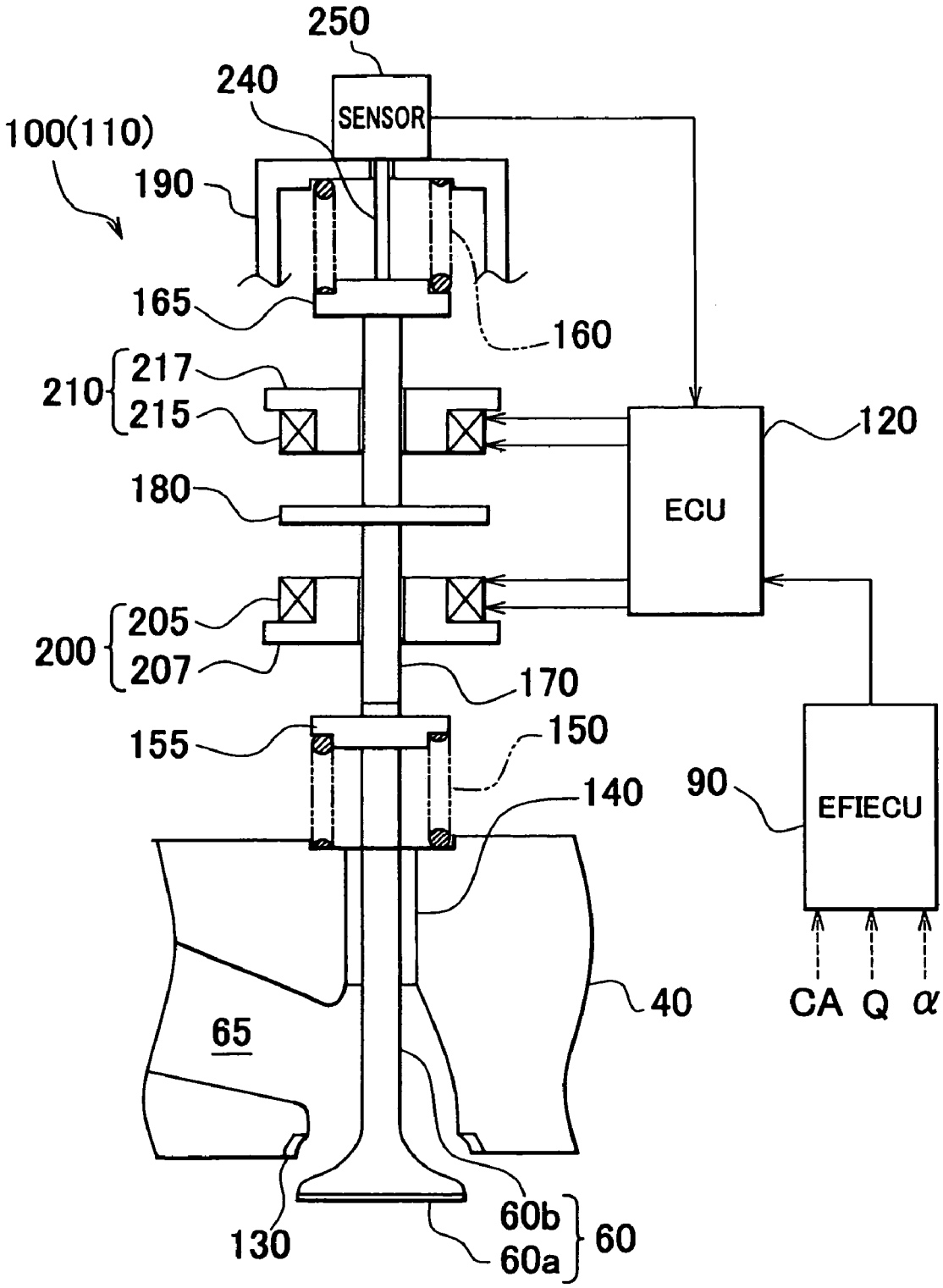
FIG. 2 is a sectional view schematically showing the configuration of an electromagnetic drive valve mechanism incorporated in the valve drive system of the first exemplary embodiment.

In the cylinder head 40 are provided electromagnetic valve drive mechanisms 100, 110 that are configured to open/close the intake valve 60 and the exhaust valve 70, respectively, utilizing electromagnetic force. FIG. 2 is a sectional view schematically showing the construction of an intake-side electromagnetic valve drive mechanism 100 incorporated in this valve drive system. Here, it should be noted that an exhaust-side electromagnetic valve drive mechanism 110 for driving the exhaust valve 70 has substantially the same construction as the intake-side electromagnetic valve drive mechanism 100, and therefore is not shown in the drawing.

Referring to FIG. 2, the intake-side electromagnetic valve drive mechanism 100 includes an upper spring 160 urging the intake valve 60 in one direction, a lower spring 150 urging the intake valve 60 in a direction opposite to the direction the upper spring 160 urges the intake valve 60, an armature shaft 170 placed in contact with one end of the intake valve 60 and driven to move forward and backward along its axial direction, an armature 180 provided on the armature shaft 170, and upper and lower magnets 210, 200 each excited to attract and abut on the armature 180 thereby bringing the intake valve 60 to a fully open or closed position.

The intake valve 60 includes a valve body 60*a* and a valve shaft 60*b*. The intake valve 60 is opened to place the combustion chamber 80 and an intake port 65 formed in the cylinder head 40 in communication, and is closed to shut off that communication. Along the periphery of the outlet of the intake port 65 is formed a valve seat 130 onto which the valve body 60*a* is seated when closed. Also, in the cylinder head 40, a shaft loop having a cylindrical valve guide portion 140 on its interior wall is formed along the axial direction of the valve shaft 60*b* such that the valve shaft 60*b* is driven to move while the valve shaft 60*b* and the valve guide portion 140 are kept securely sealed.

A lower retainer 155 having a disk shape is provided along the upper portion of the valve shaft 60*b*. The upper end of the valve shaft 60*b* is in contact with the lower end of the armature shaft 170 so that these shafts together move upward and downward. An upper retainer 165 is provided on the upper end of the armature shaft 170, and the armature 180 is provided on the middle portion of the armature shaft 170.

The armature shaft 170 is held in position while urged by the upper spring 160 and the lower spring 150. The upper spring 160 is disposed compressed between the top surface of the upper retainer 165 and an interior surface of an upper cap 190 fixed to a flange, not shown in the drawing. Meanwhile, the lower spring 150 is disposed compressed between the bottom surface of the lower retainer 155 and one surface of the cylinder head 40. Thus, the upper spring 160 produces force to open the intake valve 60 while the lower spring 150 produces force to close it. Urged by these springs, the armature shaft 170 is held substantially at the center position between the fully open position and the fully closed position in its default state.

The upper magnet 210 is located above the armature 180 and fixed to a flange not shown in the drawing while the lower magnet 200 is located below the armature 180 and fixed to another flange not shown either. The upper magnet 210 includes an upper core 217 and upper coil 215. Applying current to the upper coil 215 produces an electromagnetic field providing electromagnetic force that attracts the armature 180 onto the valve seat 130 so as to close the intake valve 60. Likewise, the lower magnet 200 includes a lower core 207 and a lower coil 205, and applying the lower coil 205 produces an electromagnetic field providing electromagnetic force that attracts the armature 180 so as to open the intake valve 60. Hereinafter, the position where the valve 160 is fully open will be referred to as a "fully open position" and the position where the valve 160 is fully closed will be referred to as "a fully closed position." Each of the upper core 217 and the lower core 207 has a shaft loop formed along its coaxial center, and the armature shaft 170 is inserted into these loops so that the armature shaft 170 moves upward and downward when driven by the electromagnetic force of the upper magnet 210 and the lower magnet 200.

A lift sensor 250 for measuring the amount the intake valve 60 is lifted (will hereinafter be referred to as "lift amount" where appropriate) is disposed above the upper cap 190. More specifically, the lift sensor 250 outputs voltage V varying in accordance with the position of a needle 240 provided along the axial direction of the armature shaft 170. The lift sensor 250 is connected to an ECU (Electronic Control Unit) 120 governing the open-close operation of the intake valve 60 so that the reading (i.e., voltage V) of the lift sensor 250 is input to the ECU 120 and used during its control procedure for deactivating the intake valve 60 (will be referred to as "valve deactivation control"). The ECU 120 applies at predetermined timings drive current to the upper magnet 210 and the lower magnet 200, respectively. Also, the ECU 120 is connected to an EFI ECU 90 so that, for example, the ECU 120 starts the valve-deactivation control upon receiving a corresponding command from the EFI ECU 90.

During normal operation of the vehicle, the EFI ECU 90 receives signals indicative of crank angle CA, intake quantity Q, accelerator depression a, and so on, and determines the operating state of the vehicle using such parameters. Based on the determined operating state, the EFI ECU 90 then computes appropriate timings to open and close the valves and outputs information regarding those timings to the ECU 120. Receiving that timing information, the ECU 120 accordingly opens and closes the valves 160 by applying current to each the lower magnet 200 and the upper magnet 210.

Figure 3:
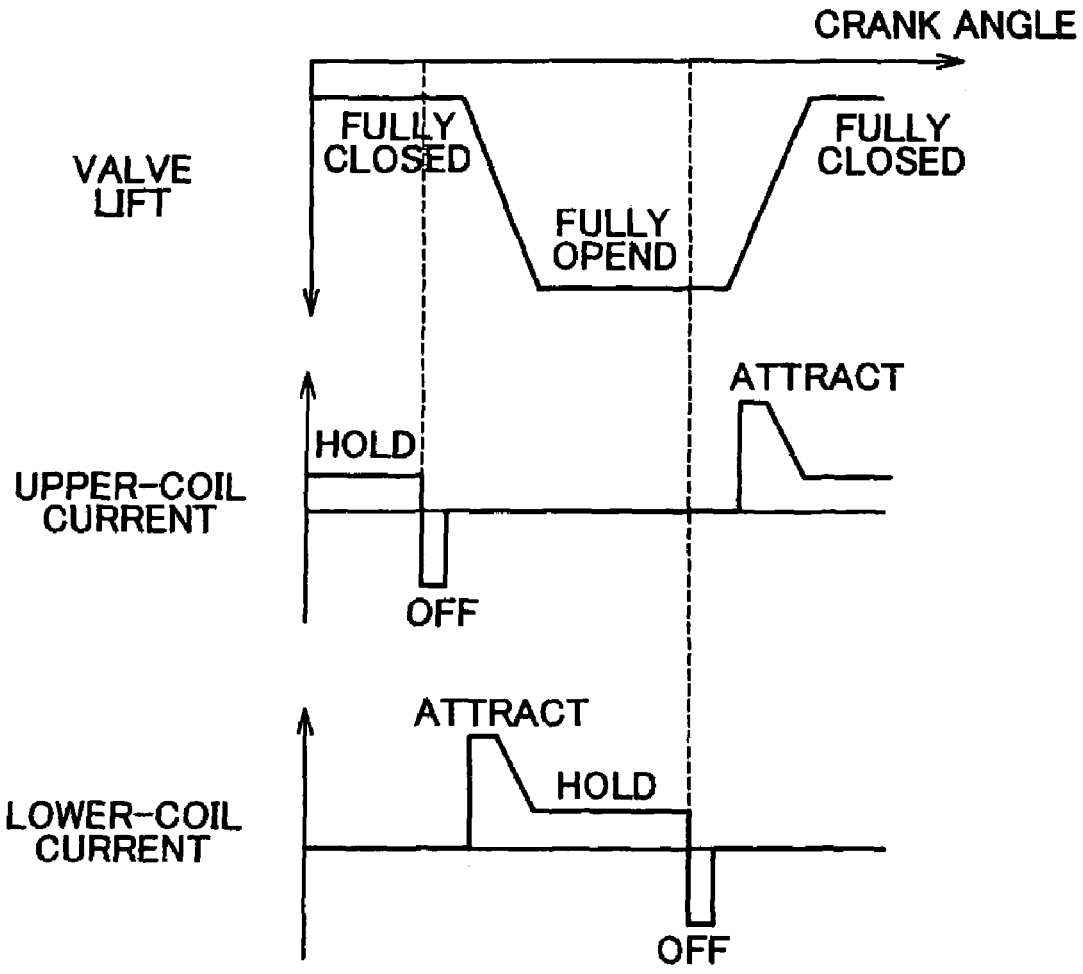
FIG. 3 is a chart illustrating one exemplary relationship between an amount that the valve is lifted and application of current to each coil.

FIG. 3 is a chart illustrating one exemplary relationship between the lift amount of the valve 60 and application of current to each coil. Referring to FIG. 3, the current to the upper coil 215 holding the intake valve 60 at the fully closed position is first cut off whereby the intake valve 60 starts moving in return towards the fully-open position. Such current applied to hold a valve at its fully open or closed position will hereinafter be referred to as "holding current." After a prescribed length of time, current is then applied to the lower coil 205 so as to attract the valve 60. This attracting force acts on the valve 60 while it is displacing under the force of the springs so as to assure quick response in the valve drive. Such current for attracting the valve (i.e., armature) will hereinafter be referred to as "attracting current". Typically, holding current may be minimum current required to hold the armature 180 on each magnet against each spring force. Meanwhile, attracting current is required to be large enough to attract the armature 180 during its displacement beyond the space between the armature 180 and each magnet, therefore it is usually set larger than holding current.

As already mentioned above, in the case of FIG. 3, the holding current to the upper coil 215 is turned off to eliminate the attracting force of the upper magnet 210. At this time, the armature 180 (i.e., valve 60) starts displacing towards the middle position under the force of the upper spring 160. After a prescribed length of time, current is then applied to the lower coil 205 so that the lower magnet 200 attracts the armature 180 approaching it. When the lower magnet 200 and the armature 180 abut on each other, holding current is then applied to the lower magnet 200 to hold the intake valve 60 at the fully open position. After a while, the holding current to the lower magnet 200 is then cut off in return, and attracting current is applied to the upper magnet 210 after a prescribed length of time in the same way as stated above. Thus, each valve is opened and closed by repeatedly turning on and off current (i.e., holding current, attracting current) to the upper magnet 210 and the lower magnet 200, respectively.

Figure 4:
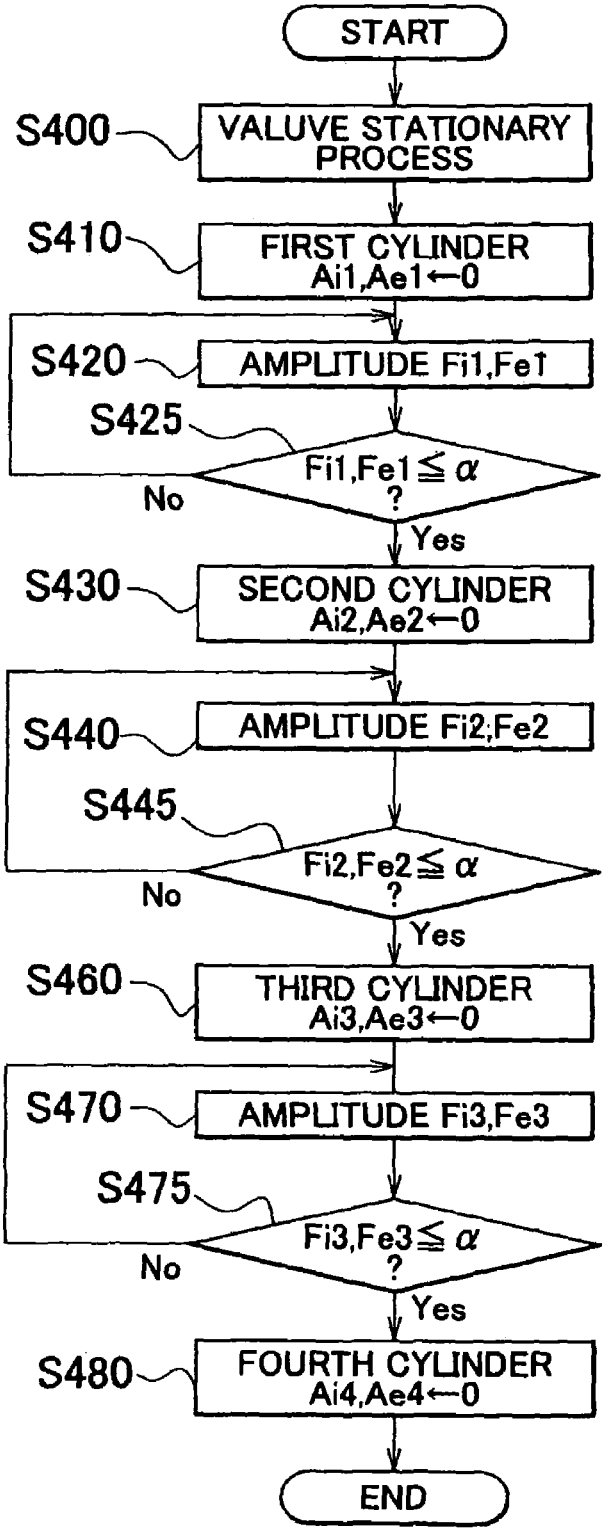
FIG. 4 is a flowchart illustrating a routine of a control procedure for deactivating the valves in the first exemplary embodiment.

Next, one exemplary control procedure for deactivating the valves will be described with reference to FIG. 4. FIG. 4 shows the routine of the same procedure executed by the ECU 120. Referring to FIG. 4, the ECU 120 receives a command for deactivating the valves from the EFI ECU 90, and performs a "valve stationary process", a process for placing the valves in their stationary positions (step S400). In this process, the exhaust valve 70 is placed at the fully open position by applying current to the lower magnet 200, and the intake valve 60 is placed at the fully closed position by applying current to the upper magnet 210. Thus, the valves are placed at their fully open and closed positions, respectively. This process is performed in each cylinder. If the vehicle is of a type which stops the engine 10 during a certain stage of its running operation (e.g., hybrid vehicle, vehicle having idling stop mode), the valves are held in such stationary positions and reactivated upon restarting the engine. In this case, therefore, the ECU 120 executes the routine of FIG. 4 when the vehicle operation is stopped.

Subsequently, the ECU 120 turns off holding current Ai1 to the intake valve 60 of the first cylinder and holding current Ae1 to the exhaust valve 70 of the same cylinder (step S410). At this time, the intake valve 60 and the exhaust valve 70 start oscillating relative to each middle position due to the force of the springs. This oscillation of each valve decays due to frictions, and stops in time. The ECU 120 then reads amplitude Fi1 of free oscillation of the intake valve 60, and amplitude Fe1 of free oscillation of the exhaust valve 70 via each lift sensor 250 (step S420). These amplitude values are determined based on changes in voltage V of each lift sensor 250 observed during a prescribed length of time. Then, the ECU 120 determines whether the values of amplitudes Fi1, Fe1 have sufficiently reduced (step S425). If it is determined in this step that these values have already reduced below a predetermined valve α, the ECU 120 proceeds to a control stage for the second cylinder where the ECU 120 first turns off holding current Ai2, Ae2 corresponding to holding current Ai1, Ae1 for the first cylinder (step S430).

Subsequently, as in the case of the first cylinder, the ECU 120 reads amplitude Fi2, Fe2 (step S440), and determines if free oscillation of each valve of the second cylinder has decayed enough (step S445). If yes, the ECU 120 then proceeds to a control stage for the third cylinder where the ECU 120 first turns off holding currents Ai3, Ae3 (step S460) and makes the same determination as to the amplitude of free oscillation of each valve (step S475). If yes in step S475, the ECU 120 then turns off holding currents Ai4, Ae4 to the valves 60, 70 of the fourth cylinder. Conversely, if the ECU 120 determines in step S475 that the free oscillation has not yet decayed enough, the ECU 120 repeats the same determination until each amplitude becomes lower than the predetermined value α.

Figure 5:
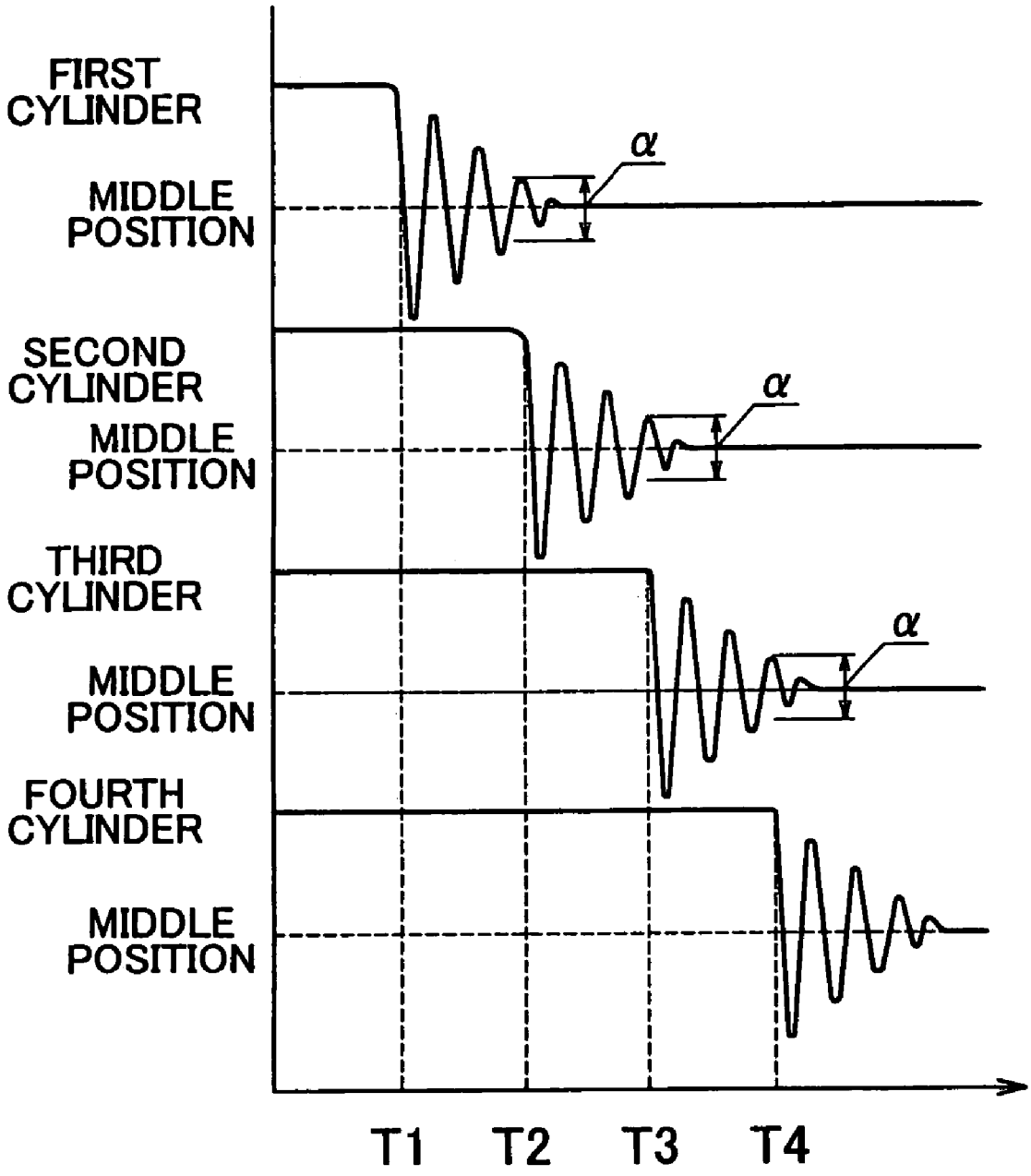
FIG. 5 is a graph representing oscillation of each valve observed during execution of the routine of FIG. 4.

FIG. 5 is a graph representing oscillation of each valve observed during the above routine. Referring to FIG. 5, in each cylinder, holding current to one valve is turned off when the amplitude of free oscillation of another valve reduces below the predetermined value α (time t2, t3, t4) so that the valves start oscillating at different timings.

Thus, according to the first exemplary embodiment, the holding current to each valve is turned off when the free oscillation of the valve has decayed enough, whereby noise by such free oscillation of each valve does not occur at the same time. Namely, the overall noise level from the valves reduces owing to such different timings of noise occurrence. Additionally, free oscillation of each valve is measured and holding current to the valve(s) of the next cylinder is immediately turned off in response to detecting that the measured oscillation (i.e., amplitude) has decayed enough. In this way, it is possible to quickly deactivate all the valves. Also, while the timing of turning off holding current to each valve is determined while monitoring the amplitude, of free oscillation of each valve via each lift sensor 250 in the first exemplary embodiment, the same current to each valve may be sequentially turned off at prescribed time intervals long enough for each valve oscillation to decay to a target level. Also, while the holding current to the intake valve 60 and that to the exhaust valve 70 are simultaneously turned off in the first embodiment, they may be turned off at different timings in each cylinder. Furthermore, such timings of turning off holding current may be different between tow or more valve groups, i.e., a group consisting of the valves in the first and second cylinders and a group consisting of the valves in the third and fourth cylinders. In this case, too, the same advantage and effect can be obtained.

Figure 6:
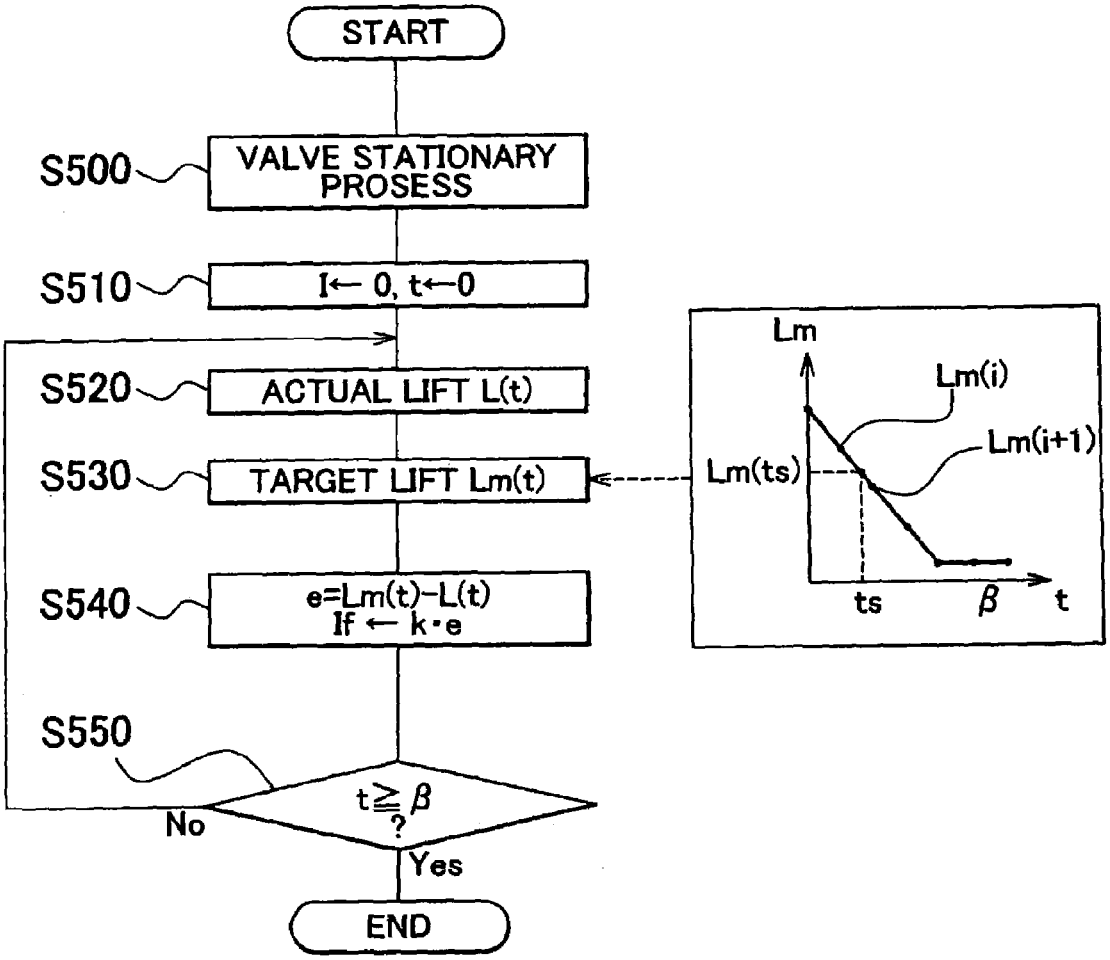
FIG. 6 is a flowchart illustrating a routine of a control procedure for deactivating valves in a second exemplary embodiment.

Next, a valve drive system according to a second exemplary embodiment of the present invention will be described. This system has substantially the same configuration as the valve drive system of the first embodiment but is different in that the ECU 120 is constructed to execute a different valve deactivation control, therefore like numerals will be used to indicate like elements in the following description. FIG. 6 is a flowchart showing the routine of the valve deactivation control adopted in the valve drive system of the second exemplary embodiment. Although the flowchart only represents the procedure for one cylinder for descriptive convenience, it should be noted that the procedure is also performed to other cylinders. Referring to FIG. 6, the ECU 120 first executes the same valve stationary process as described in the first exemplary embodiment to place each valve in the fully closed or open position (step S500). The following steps of this control will hereinafter be described with respect to the exhaust valve 70.

First, the ECU 120 once turns off holding current Ih to the exhaust valve 70, and starts counting time t (step S510). Then, the ECU 120 determines the present value of an actual lift amount L (t0) by reading voltage V of the lift sensor 250 (step S520). Subsequently, the ECU 120 reads a target lift amount Lm (t0) from data memory, not shown in the drawing (step S530).

Figure 7:
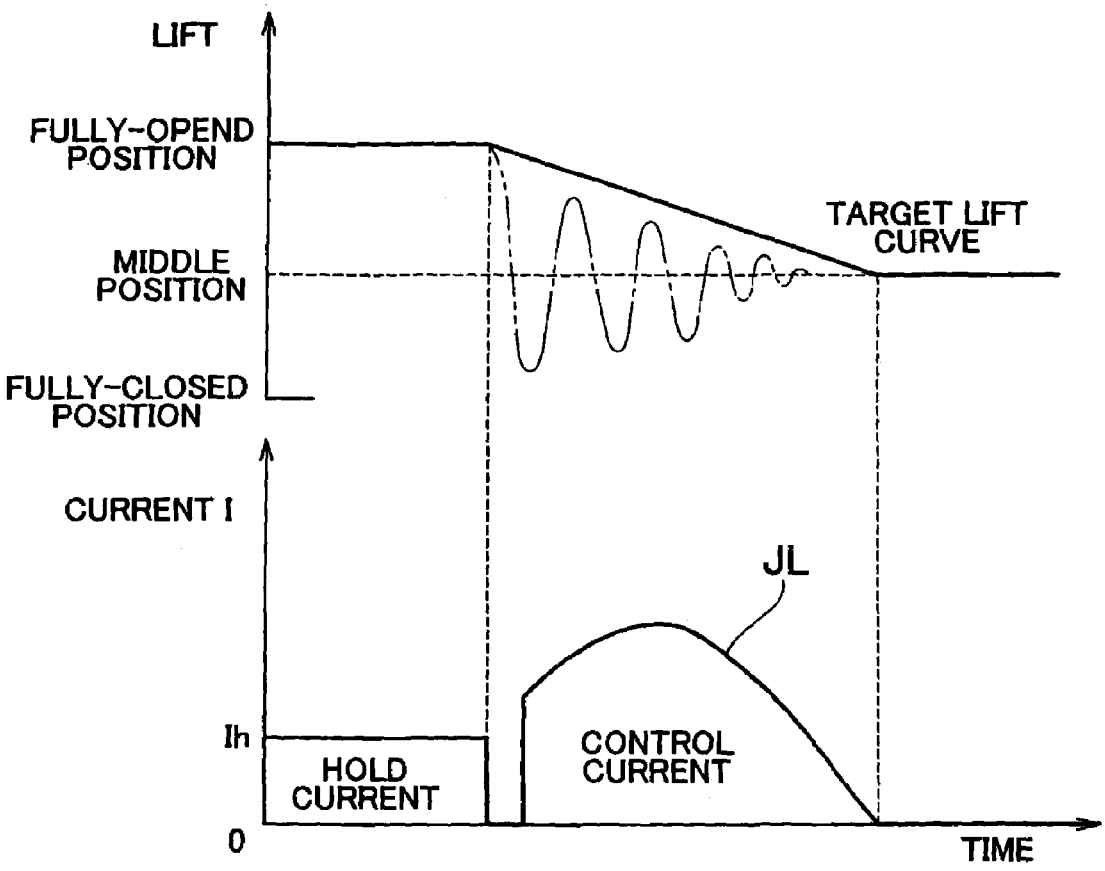
FIG. 7 is a graph schematically showing changes in a target lift amount adopted in the second exemplary embodiment.

FIG. 7 is a graph illustrating one example of the target lift amount Lm (t) that changes in time. In this graph, the double-dashed line curve represents free oscillation of the valve which occurs after holding current to the same valve has been turned off, as aforementioned in the first exemplary embodiment. Meanwhile, the solid line in the graph represents the target lift amount for displacing the exhaust valve 70 linearly from the fully open position to the middle position. This target lift amount is a time function stored in the form of a map as shown in the box of FIG. 6, and the target lift amount Lm is set using the map at prescribed time intervals. With this map, more specifically, the ECU 120 calculates the target lift amount Lm at time ts through interpolation of the target lift amount Lm (i) of the preceding cycle and the target lift amount Lm (i+1) of the following cycle. Alternatively, such a target lift amount may be calculated using a predetermined function that linearly changes with respect to time so that the target lift amount is set to a value corresponding to each timing. Here, it should be noted that the target lift amount is not necessarily an amount which causes the valve to displace "linearly" as long as the valve does not oscillate excessively during its displacement to the middle position.

Next, the ECU 120 then detects difference e between target lift amount Lm (t0) and actual lift amount L (t0) at time t0, and sets control current If by multiplying gain K with the detected difference e (step S540). After that, the ECU 120 determines if control end time β has elapsed (step S550). Since time t is t0 at present, namely, the control end time β has not yet elapsed, the ECU 120 applies control current If set in step S540 to the lower coil 205 and returns to step S520. Supplied with control current If, the lower coil 205 generates electromagnetic force attracting the exhaust valve 70 which is about to displace or has just started displacing from the fully closed position towards the middle position. Thus, the exhaust valve 70 displaces each time to a position at which the electromagnetic force from the lower coil 205 and the force of the lower spring 150 reach equilibrium. At this time ($ta=t0 \leqq ta<\beta$), the ECU 120 again detects difference e between actual lift amount L (ta) read in step S520 and target lift amount Lm (ta) determined in step S530, and sets control current If by multiplying gain K with difference e (step S540). Since control end time β has not yet elapsed, the ECU 120 applies the set control current to the lower coil 205. In this way, the ECU 120 repeats steps S520, S530, and S540 so that actual lift amount L approaches target lift amount Lm. In other words, a feed back control is performed such that the value of difference e becomes zero. Thus, application of current to the lower coil 205 is repeated so as to achieve the target value until the control routine ends in response to elapse of control end time β.

As described above, the exhaust valve 70 displaces from the fully closed position to the middle position while its lift amount is controlled to the target lift amount determined each time. This reduces the chance or degree of oscillation of the exhaust valve 70, and is therefore effective in eliminating or reducing the noise that may be caused due to the exhaust valve 70 oscillating. Also, while holding current Ih is turned off in the second exemplary embodiment, this current is not necessarily turned off, but may only be reduced to an extent that the electromagnetic force of the lower magnet 200 becomes smaller than each spring force. Also, although the feedback control in the above exemplary embodiments uses a simple proportional computation method, it may alternatively use a so-called PID computation method adopting derivation and integration of deviation from target values. Optionally, the control current to the lower magnet 200 may be preset as indicated by a solid line curve JL in FIG. 7, and an appropriate feed-forward control may be performed by changing the control current with respect to time.

Figure 8:
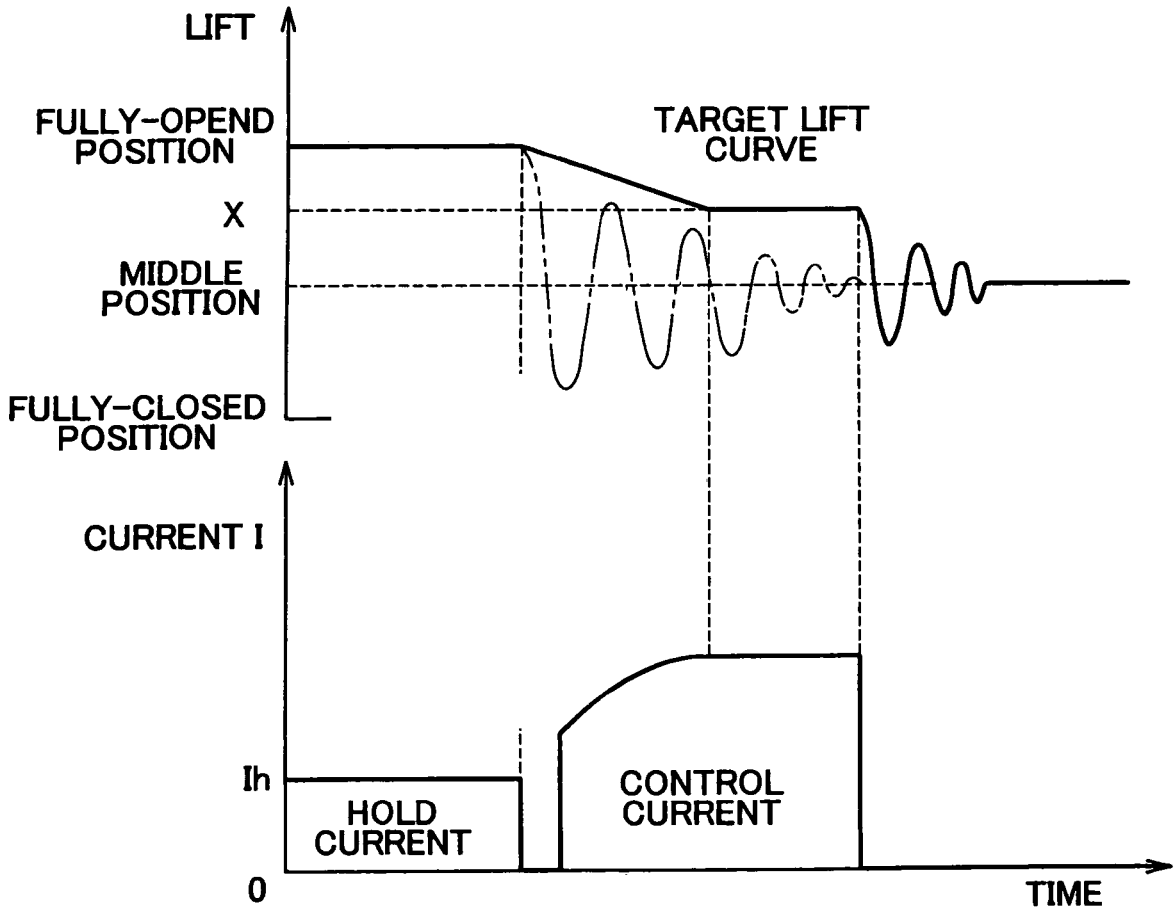
FIG. 8 is a graph schematically showing changes in a target lift amount in one modification example of the second exemplary embodiment.

Furthermore, the valve deactivation control procedures adopted in the first and second exemplary embodiments may be performed in combination. FIG. 8 shows one example of such a case. Referring to FIG. 8, the exhaust valve 70 displaces from the fully open position to position X while its lift amount is controlled through the feedback routine shown in FIG. 6 using a target lift amount that causes the valve 70 to lineally displace from the fully open position to position X. Then, the control current to the lower magnet 200 is turned off in response to elapse of a prescribed time from the exhaust valve 70 reaching position X, whereby the exhaust valve 70 starts oscillating about the middle position from position X. In this case, however, the oscillating width is relatively small resulting in vibration of a relatively small intensity and small noise. In the second embodiment, the off-valve noise is further reduced if deactivation of each valve is timed such that free oscillation of one valve occurs after free oscillation of another valve has decayed enough. Also in this case, the power consumed by the magnet can be made smaller than when all the valves are simultaneously displaced to the middle position.

While the invention has been described with reference to preferred embodiments thereof, it is to be understood that the invention is not limited to the preferred embodiments or constructions. To the contrary, the invention is intended to cover various modifications and equivalent arrangements such as an engine construction including a different number of cylinders. In addition, while the various elements of the preferred embodiments are shown in various combinations and configurations, which are exemplary, other combinations and configurations, including more, less or only a single element, are also within the spirit and scope of the invention.

What is claimed is:

1. A valve drive system for an internal combustion engine, comprising:

a plurality of valves;

springs urging each of the valves towards a middle position between a fully open position and a fully closed position;

magnets each supplied with current to generate electromagnetic force to retain each of the valves at the fully open or closed position against the urging force of each spring;

a controller that is adapted to stop application of current to at least one magnet for a first valve or a first valve group among the valves at a first timing and stop application of current to at least one magnet for a second valve or a second valve group among the valves at a second timing that is different from the first timing when the internal combustion engine is to be stopped; and a valve displacement detector that detects an amount that the valve is displaced due to its free oscillation, wherein the controller is further adapted to determine based on the valve displacement amount detected by the valve displacement detector that the free oscillation of the first valve or the first valve group has decayed to a specific level.

2. A valve drive system according to claim 1, wherein the valves are intake valves and exhaust valves of the internal combustion engine.

3. A valve drive system according to claim 1, wherein the second timing is when free oscillation of the first valve or the first valve group has decayed to a specific level.

4. A valve drive system for an internal combustion engine, comprising:

at least one valve;

springs urging the at least one valve towards a middle position between a fully open position and a fully closed position;

at least one magnet supplied with current to generate electromagnetic force to retain the at least one valve at the fully open or closed position against the urging force of each spring, and a controller that is adapted to apply current to the at least one magnet, when application of the current to the at least one magnet is to be stopped to stop the internal combustion engine, in such a way that the at least one magnet generates electromagnetic force to bring the at least one valve to the middle position or a position closer thereto before stopping the current to the at least one magnet.

5. A valve drive system according to claim 4, wherein the valve is an intake valve or an exhaust valve of the internal combustion engine.

6. A valve drive system according to claim 4, further comprising a valve lift detector for detecting an amount that the valve is lifted, wherein the controller is further adapted to perform a feedback control such that the detected valve lift amount converges on a prescribed target amount that changes in time.

7. A valve drive system according to claim 4, wherein the controller is further adapted to stop application of current to the magnet at a predetermined timing when the valve has been brought from the fully open or closed position to a prescribed position close to the middle position.

8. A valve drive system according to claim 7, wherein the valve is provided in plurality, and the predetermined timing is set for each one of the valves or each one of valve groups formed among the valves.

9. The valve drive system for an internal combustion engine according to claim 4, wherein the at least one valve being a plurality of valves; and the controller is adapted to stop application of current to at least one magnet for a first valve or a first valve group that is associated with a first cylinder at a first timing and stop application of current to at least one magnet for a second valve or a second valve group that is associated with a second cylinder at a second timing that is a predetermined time later from the first timing when the internal combustion engine is to be stopped.

10. The valve drive system for an internal combustion engine according to claim 4, wherein the at least one valve being a plurality of valves; and the controller is adapted to stop application of current to at least one magnet for a first valve or a first valve group at a first timing and stop application of current to at least one magnet for a second valve or a second valve group at a second timing that is a predetermined time later from the first timing when the internal combustion engine is to be stopped, the predetermined time being the time needed for a free oscillation of the first valve to decay to a specific level.

11. A method for driving a plurality of valves mounted in an internal combustion engine including springs urging each valve towards a middle position between a fully open position and a fully closed position and magnets each supplied with current to generate electromagnetic force to retain each valve at the fully open or closed position against the urging force of each spring, the method comprising:

stopping application of current to at least one magnet for a first valve or a first valve group among the valves at a first timing;

stopping application of current to at least one magnet for a second valve or a second valve group among the valves at a second timing that is different from the first timing when the internal combustion engine is to be stopped;

detecting an amount that the valve is displaced due to its free oscillation; and determining based on the detected valve displacement amount that the free oscillation of the first valve or the first valve group has decayed to a specific level.

12. A method according to claim 11, wherein the valves include an intake valve or exhaust valve of the internal combustion engine.

13. A method according to claim 11, wherein the second timing is when free oscillation of the first valve or the first valve group has decayed to a specific level.

14. A method for driving at least one valve mounted in an internal combustion engine including springs urging the at least one valve towards a middle position between a fully open position and a fully closed position and at least one magnet supplied with current to generate electromagnetic force to retain the at least one valve at the fully open or closed position against the urging force of each spring, the method comprising:

applying current to the at least one magnet, when application of the current to the at least one magnet is to be stopped to stop the internal combustion engine, in such a way that the at least one magnet generates electromagnetic force to bring the at least one valve to the middle position or a position closer thereto before stopping the current to the at least one magnet.

15. A method according to claim 14, wherein the valve is an intake valve or an exhaust valve of the internal combustion engine.

16. A method according to claim 14, further comprising:

detecting an amount that the valve is lifted; and performing a feedback control such that the detected valve lift amount converges on a prescribed target amount that changes in time.

17. A method according to claim 14, wherein application of current to the magnet is stopped at a predetermined timing when the valve has been brought from the fully open or closed position to a prescribed position close to the middle position.

18. A method according to claim 17, wherein the valve is provided in plurality, and the predetermined timing is set for each one of the valves or each one of valve groups formed among the valves.

19. The method for driving at least one valve according to claim 14, the at least one valve being a plurality of valves further comprising:

stopping application of current to at least one magnet for a first valve or a first valve group among the plurality of valves at a first timing; and stopping application of current to at least one magnet for a second valve or a second valve group among the plurality of valves at a second timing that is a predetermined time later from the first timing when the internal combustion engine is to be stopped, the predetermined time being the time needed for a free oscillation of the first valve to decay to a specific level.

20. The method for driving at least one valve according to claim 14, the at least one valve being a plurality of valves, the method further comprising:

stopping application of current to at least one magnet for a first valve or a first valve group among the plurality of valves that is associated with a first cylinder at a first timing; and stopping application of current to at least one magnet for a second valve or a second valve group among the plurality of valves that is associated with a second cylinder at a second timing that is a predetermined time later from the first timing when the internal combustion engine is to be stopped.

* * * * *